United States Patent [19]

Welp et al.

[11] Patent Number: 4,775,110

[45] Date of Patent: Oct. 4, 1988

[54] METHOD OF AND APPARATUS FOR THE AUTOMATIC WINDING OF A WEB OF SHEET MATERIAL

[75] Inventors: Ewald G. Welp, Erkrath; Herbert Schönmeier, Düsseldorf; Waldemar Neumann; Reinhard Hehner, both of Haan; Georg Möller, Neuss, all of Fed. Rep. of Germany

[73] Assignee: Jagenberg Aktiengesellschaft, Dusseldorf, Fed. Rep. of Germany

[21] Appl. No.: 35,629

[22] Filed: Apr. 3, 1987

[30] Foreign Application Priority Data

Apr. 9, 1986 [DE] Fed. Rep. of Germany ..... 3611895

[51] Int. Cl.[4] ..... B65H 35/02

[52] U.S. Cl. ..... 242/56.8; 242/66; 242/75.4

[58] Field of Search ..... 242/56 R, 66, 56.8, 242/75.4

[56] References Cited

U.S. PATENT DOCUMENTS

| | | | |
|---|---|---|---|
| 2,006,943 | 7/1935 | Coleman | 242/75.4 X |
| 3,823,887 | 7/1974 | Gerstein | 242/56.8 X |
| 3,869,095 | 3/1975 | Diltz | 242/56 R |
| 3,977,617 | 8/1976 | Salmon | 242/56.8 |
| 4,157,794 | 6/1979 | Brandauer | 242/66 |
| 4,422,588 | 12/1983 | Nowisch | 242/56 R X |
| 4,485,979 | 12/1984 | Dropczynski | 242/56 R |
| 4,487,377 | 12/1987 | Perini | 242/56.8 |
| 4,601,441 | 7/1986 | Oinonen | 242/56 R |
| 4,635,867 | 1/1987 | Kytönen | 242/56 R |

FOREIGN PATENT DOCUMENTS

| | | |
|---|---|---|
| 0118384 | 12/1984 | European Pat. Off. . |
| 8317214 | 2/1984 | Fed. Rep. of Germany . |
| 1327368 | 8/1973 | United Kingdom . |
| 2035272 | 6/1980 | United Kingdom . |
| 2050317 | 1/1981 | United Kingdom . |

*Primary Examiner*—Stuart S. Levy
*Assistant Examiner*—Katherine Matecki
*Attorney, Agent, or Firm*—Herbert Dubno

[57] ABSTRACT

The apparatus for automatically cutting and rolling up a sheet of material comprises a winder with a least one feed drum. The winder cuts the sheet of material, advantageously first the winder weakens the sheet of material along a cutting line. Then the sheet is cut through or severed by braking. The beginning of a new sheet formed by the cutting is attached to a new roll core by the winder after ejecting the finished rolled up roll and the beginning of the new sheet of material is held fixed during cutting by vacuum on the outer surface of the feed drum.

13 Claims, 5 Drawing Sheets

METHOD OF AND APPARATUS FOR THE AUTOMATIC WINDING OF A WEB OF SHEET MATERIAL

FIELD OF THE INVENTION

Our present invention relates to a method of and an apparatus for automatically cutting and rolling up or winding a web of sheet material, e.g. paper.

BACKGROUND OF THE INVENTION

A winder is known for automatically cutting and rolling up a web of sheet material on a core sleeve comprising at least one low pressure feed drum. The web of sheet material is cut away by the winder and it attaches the beginning of a new sheet to a new core sleeve after ejecting a finished roll of material.

A process of this type for automatically cutting and rolling up or coiling a web of sheet material is described in U.S. Pat. No. 3,869,095 which utilizes a twin rider roll winder with three drums. The web of sheet material can be perforated by an air cutter when it is drawn to the feed drum and is torn at the perforations by clamping a loop of the material between the feed drum and a core sleeve engaged on its circumference. This severing operation is not, however, without problems and fails when the take offs on roll interchange are not synchronized exactly with each other. This method moreover is adaptable only to the twin rider roll winder with three drums.

Another known coiling process requires a long idle time for the winder. Difficulties result here since the receiving capacity of the winder must correspond exactly to that of the paper machine connected to it.

OBJECTS OF THE INVENTION

It is an object of our invention to provide an improved apparatus for cutting and winding a web of sheet material on a core sleeve.

It is another object of our invention to provide an improved apparatus for cutting and winding or coiling in a roll a web of sheet material which provides reliable and tear-free cutting of the web of sheet material without unnecessarily long stop times or idle phases.

It is also an object of our invention to provide an improved process and apparatus for cutting and winding a web of sheet material which provides a reliable securing of the sheet ends in a fully wound roll and to a core sleeve as well as providing a reliable cutting of the web of sheet material in a designated location while avoiding tearing of the sheet in other unintended places.

SUMMARY OF THE INVENTION

These objects and others which will become more readily apparent hereinafter are attained in accordance with our invention in a process for automatically cutting and winding or coiling in a roll a web of sheet material with a winder with at least one suction core-sleeve and roll supporting web feed drum. The winder has means for severing the web of sheet material and a beginning of the following web section is attached to a new core sleeve after ejection of a finished roll of the material on the previously used core sleeve.

According to the invention the web of sheet material is cut away in the vicinity of the core-sleeve and roll supporting web feed drum acted on by suction, both sides of the cut location are provided with a trace of adhesive and the end of the roll of material being wound up is glued on the fully wound roll which continues to rotate and while the free end of the oncoming web formed by severing and which forms the beginning of a new roll, is glued to a new core sleeve.

When the web of sheet material is severed while the fully wound roll is still on the core-sleeve and roll supporting web feed drum at a location adjacent the latter, an uncontrolled tearing of the sheet of goods does not occur. Since all steps in our process such as the cutting away of the web of sheet material, the application of the adhesive, the pivoting away of the finished roll and the setting up of the core sleeve, the gluing of the beginning of a new sheet to the new core sleeve and the gluing of the sheet end of the finished roll can be automatically controlled, the idle time of the winder during changeover is considerably reduced.

In one example of our invention the web of sheet material upstream of the core-sleeve and roll supporting web feed drum is first weakened, both sides of the weakened location are coated with a trace of glue and the web of sheet material is cut away by braking or halting the web of sheet material upstream of the weakened zone.

The free ends of the cut material remain adhering to the core-sleeve and roll supporting web feed drum under vacuum until the ends of the web of sheet material being wound up on the core-sleeve and roll supporting web feed drum are glued on the finished fully wound roll. The beginning of the new sheet is glued to the newly inserted core sleeve.

To avoid an unintended tearing of the web of sheet material when it is weakened, the tension in the web of sheet material is advantageously reduced upstream of the weakened location. The regulation of the tension in the web of sheet material can be effected with a tension measuring device connected with a braking device.

There are no problems resulting from structural considerations in regard to the application of the trace of glue since it can be applied either before, after or at the same time as the weakening of the web of sheet material.

The weakening can take place by perforating, cutting into the sheet, piercing the sheet or pinching mechanically or by a gas or fluid stream, laser action or by a glowing or heated wire. Critical to all these methods is a local reduction in the tear resistivity which allows separation or severing under tension.

According to our invention a winder for a web of sheet material with at least one core-sleeve and roll supporting web feed drum with a plurality of vacuum openings on its circumference partially contacted by the web of sheet material can have upstream of the core-sleeve and roll supporting web feed drum a weakening device for weakening the web of sheet material and a brake acting on the web of sheet material. Thus the web of sheet material can be weakened and subsequently cut by operating the brake to provide an increased tension in the sheet. The cutting device advantageously is connected to an automatic winder control so that its operation is completely automatic.

To operate the weakening device for weakening the sheet of goods at the correct time it is advantageously pivotally supported in the working position. The device can comprise a cutter roller equipped with a knife which is driven in a direction opposite to the running direction of the web of sheet material.

According to another advantageous embodiment of our invention the weakening device comprises a perforating roller equipped with a perforating comb and an opposing roller provided with an elastic jacket. In this case the perforating roller equipped with the perforating comb has a clamping segment for the web of sheet material located approximately diameterically opposed to the perforating comb and is provided with a perforating roller drive and a perforating roller stopping device. When the perforating roller is driven, the clamping segment assists the sheet transport while it clamps the web when the stopping device is actuated so that a tearing force is developed in the web of sheet material by further rotation of the core-sleeve and roll supporting web feed drum which leads to tearing along the weakened line.

In a further advantageous example of our invention which is suitable for complete cutting of the web of sheet material and also for weakening a cutting device engages the web of sheet material running on the core-sleeve and roll supporting web feed drum and is located on a movable supporting member. A pivotable shaver blade is located on the supporting member in the vicinity of the web of sheet material which advantageously is connected with a shaver blade drive movable in a direction axially parallel to the core-sleeve and roll supporting web feed drum.

Advantageously when the shaver blade on the supporting member is attached to a lowering device for the finished fully wound roll the removal of the finished fully wound full can occur simultaneously with cutting away the web of sheet material.

Furthermore the cutting device can also comprise a saw stretched between at least two arms attached to the core-sleeve and roll supporting web feed drum, advantageously on a shaft of the core-sleeve and roll supporting web feed drum, or a heated wire and/or a heated wire embedded in the core-sleeve and roll supporting web feed drum jacket.

The saw or the heated wire are either moved briefly a between the core-sleeve and roll supporting web feed drum and the web of sheet material with the aid of the arms if the web of sheet material is to be cut away or they are rigidly attached to the transport and/or core-sleeve and roll supporting web feed drum and are attached to the winder control so that they are operable in a radial direction and/or for cutting through the web of sheet material in the axial parallel direction when the wire is engaged or the saw is actuated.

BRIEF DESCRIPTION OF THE DRAWING

The above and other objects, features and advantages of our invention will become more readily apparent from the following description, reference being made to the accompanying highly diagrammatic drawing in which:

FIGS. 4A and 4B are diagrams related to the embodiment of FIG. 4; and

SPECIFIC DESCRIPTION

Figures 1, 1A:
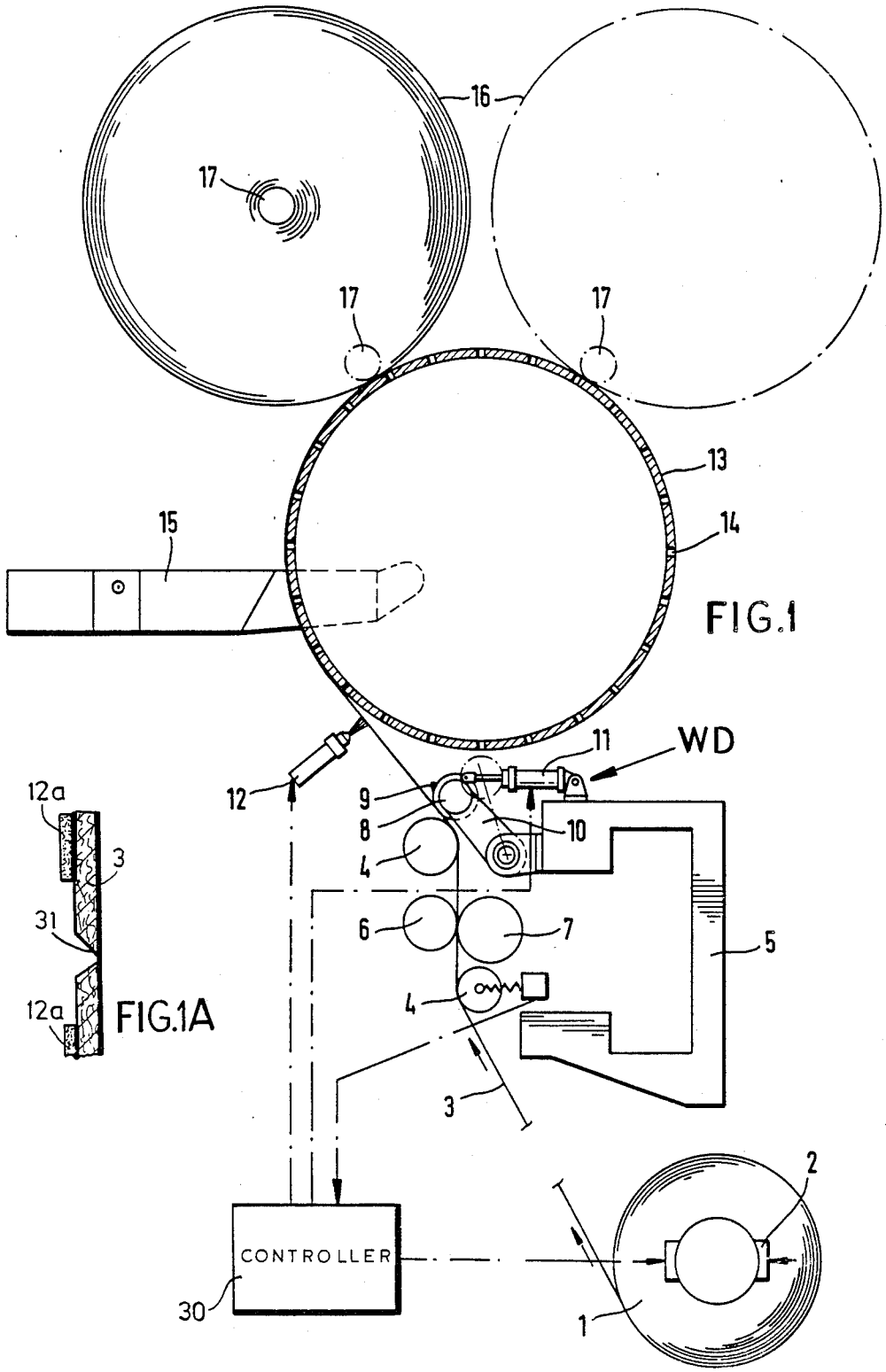
FIG. 1 is a schematic side view of a winder according to our invention.
FIG. 1A is a detail view just before severing of the weakened zone of the web, in section.

The core-sleeve and roll supporting web feed drum roller shown in FIG. 1 schematically only has a single core-sleeve and roll-supporting web feed drum 13, however the process according to our invention may also be applied to a situation in which there are two support rollers or drums for each of the core sleeves.

A web of sheet material 3 is fed from a delivery roll 1 having a brake 2 over a plurality of core-sleeve and roll supporting web feed rolls 4 mounted on a supporting member 5 and a longitudinal cutter or slitter for trimming or subdividing the web, in the form of a rotating upper knife 6 and a lower knife 7 cooperating with it to the core-sleeve and roll supporting web feed drum 13 provided with a plurality of suction openings 14 on which a core sleeve 17 rests. The interior of the drum 13 is evacuated. The core sleeve 17 functions as a roll core for the web of sheet material 3. The web of sheet material 3 is wound up on the core sleeve 17 until the desired diameter of the fully wound roll 16 is reached.

A cutter roller 8 equipped with a knife 9 is pivotally mounted by a pivoting arm 10 on the supporting member 5. The cutter roller 8 allows movement to and/or from the vicinity of the web of sheet material 3 with the help of a pivoting cylinder 11 and is provided with a cutter drive (not shown) which sets the cutter roller 8 into rotation opposite to the running direction of the web of sheet material 3. The weakening device WD comprises the cutter roller 8 and the knife 9. Adhesive spraying nozzles 12 are located in the region between the cutter roller 8 and the core-sleeve and roll supporting web feed drum 13. A lowering device 15 acts to pivot away the completed fully wound roll 16.

When a fully wound roll is completed the pull of the brake 2 on the web of sheet material 3 is reduced by decreasing the braking moment generated by the brake 2 under the control of a controller 30. Then the cutter roller 8 is pivoted with the aid of the pivot cylinder 11 against the web of sheet material 3 and is set in rotation opposing the running direction of the web of sheet material 3 by the cutter roller drive.

Simultaneously the adhesive spraying nozzles 12 positioned along the entire width of the web of sheet material 3 are operated and make a glue trace or trace of adhesive 12*a* running across the web of sheet material. When the cutter roller 8 with the knife 9 is rotated a scoring 31 (FIG. 1A) is produced in the web of sheet material 3 which leads to a weakening. After the weakened zone has been brought to the core-sleeve and roll supporting web feed drum 13, the adhesive spraying nozzles 12 are operated once again so that an additional glue trace or trace of adhesive 12*a* arises running transversely across the web of sheet material 3.

By operation of the brake 2 of the delivery roll 1 the web of sheet material 3 is severed sharply in the vicinity of the weakened zone. The sheet ends however adhere to the surface of the core-sleeve and roll supporting web feed drum 13 because of the lower pressure or vacuum occurring at the vacuum openings 14 of the core-sleeve and roll supporting web feed drum 13 until the sheet end of the first web section arrives on the fully wound roll 16 and is glued to it.

The next web section starting from the delivery roll 1 remains checked or braked and the core-sleeve and roll supporting web feed drum 13 rotates under the adhering sheet. After removal of the completed roll and release of the brake 2 the beginning of the next web section with adhesive applied is transported from the core-sleeve and roll supporting web feed drum 13 to the empty core and is glued to it.

Understandably two parallel rows of adhesive spraying nozzles 12 operable at the same time can be positioned upstream of the roller 8 so that twin adhesive traces can be formed on both sides of the weakened region of the web of sheet material 3.

Figure 2:
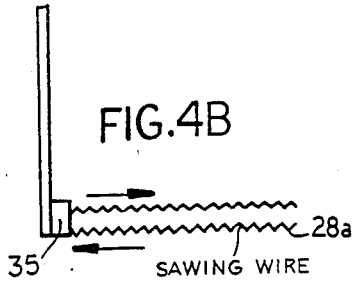
FIG. 2 is a schematic side view of a winder according to our invention with a cutting device different from that of FIG. 1.
Figure 2:
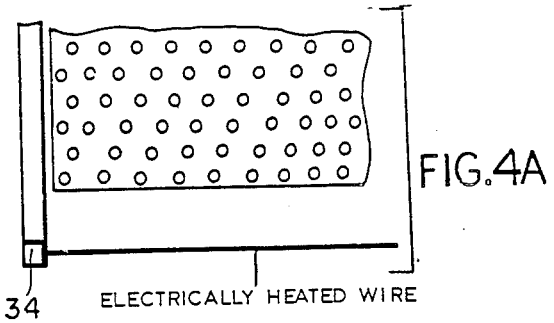
Figure 2:
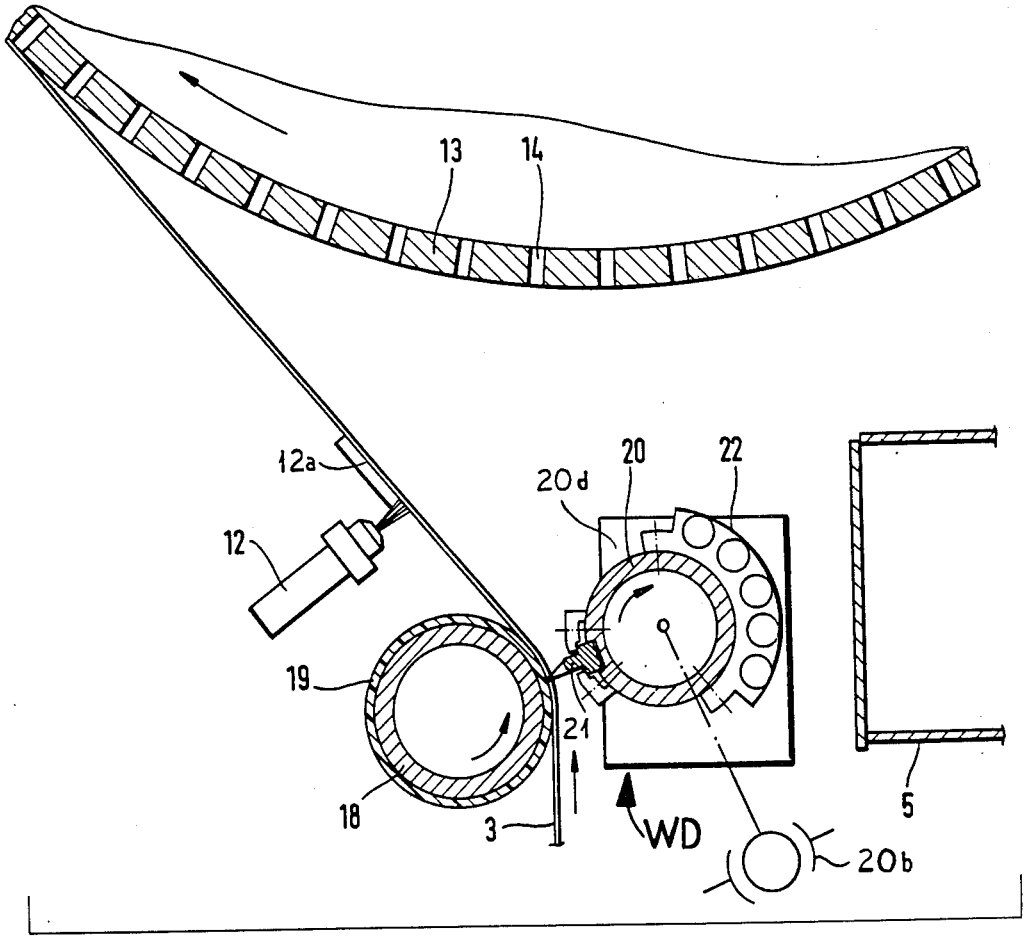

The weakening device WD according to FIG. 2 comprises a perforating roller 20 with a perforating comb 21 and an opposing roller 18 with an elastic jacket or outer surface 19. The perforating roller 20 is provided with a clamping segment 22 which is located approximately diameterically opposite to the perforating comb 21. It is connected with a perforating roller drive 20*d* and a perforating roller stopping device or brake 20*b*.

Figure 2A:
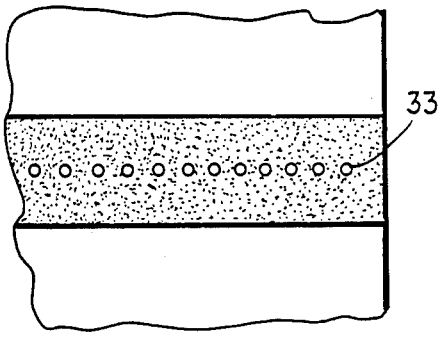
FIGS. 2A–2C are fragmentary elevational views illustrating the principles of the invention.
Figure 2B:
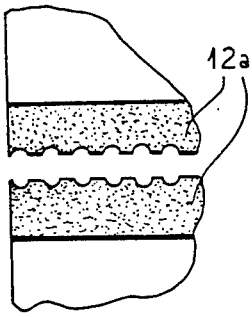
Figure 2C:
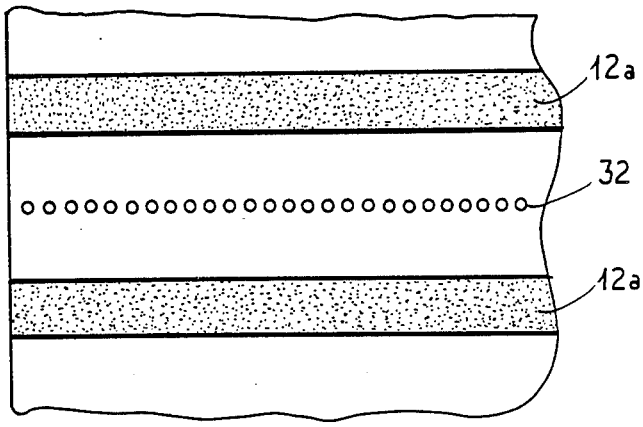

To provide the web of sheet material 3 with a weakened zone the perforating roller 20 whose comb 21 is in the resting position is rotated so that the web of sheet material 3 is not contacted. The comb 21 then moves with the web of sheet material 3 over the opposing core-sleeve and roll supporting web feed roller 18 and makes a line of perforations 32 or 33 in FIGS. 2A and 2C.

After that the perforating roller 20 is braked before the clamping segment 22 comes in contact with the web of sheet material 3 and the opposing roller 18. After that the perforations in the web of sheet material 3 are advanced until on the core-sleeve and roll supporting web feed drum 13, the perforating roller 20 accelerates and at the moment in which the clamping segment 22 engages the web of sheet material 3 between itself and the opposing core-sleeve and roll supporting web feed roll 18, the roller 20 is again braked or stopped while the core-sleeve and roll supporting web feed drum 13 is further rotated. Thus a tearing force arises between the fully wound roll 16 and the opposing roller 18 which cuts the web of sheet material 3 weakened at the perforations (compare FIGS. 2A and 2B).

Then the perforating roller 20 is driven anew by drive 20*d* as long as the clamping segment 22 is in contact with the core-sleeve and roll supporting web feed roller 18 to assist sheet transport with a fresh impetus. Note that in FIGS. 2A and 2B, a single glue strip was applied before, during and after formation of the row of perforations, but that after severing, glue strips 12*a* are on both ends of the severed web.

Figure 3:
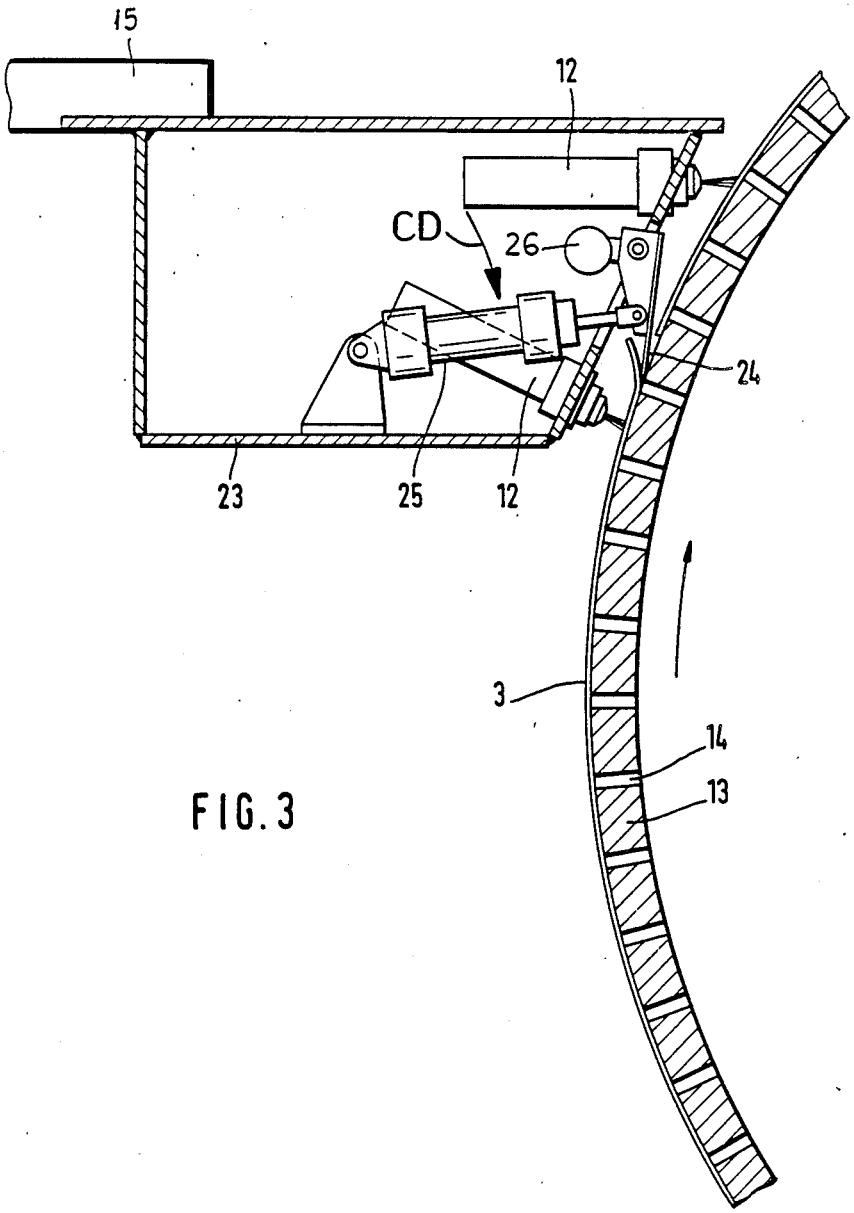
FIG. 3 is a schematic side view of a winder with a further variant of the cutting device according to our invention.

The cutting device CD according to FIG. 3 comprises a shaver blade 24 pivotally mounted on the supporting member 23. The supporting member 23 is advantageously attached to the lowering device 15 shown schematically in FIGS. 1 and 3 and allows motion of the shaver blade 24 in the vicinity of the core-sleeve and roll supporting web feed drum 13. The shaver blade 24 can be moved against the web of sheet material 3 by a piston-and-cylinder unit 25 and cuts through it in the illustrated way. Simultaneously two rows of adhesive spraying nozzles 12 are cyclically operated so that a glue trace or trace of adhesive 12*a* is provided on the sheet ends and the beginning of the next sheet. To assist the cutting through of the web of sheet material 3*a* shaver blade drive 26 for the shaver blade 24 comprises a piston-and-cylinder-unit axially parallel to the core-sleeve and roll supporting web feed drum 13. The shaver blade drive 26 puts the shaver blade 24 in motion transverse to the running direction of the web of sheet material 3 and makes a saw cut when the cutting edges of the shaver blade 24 are like a saw.

The web of sheet material 3 can be completely cut through by the shaver blade 24 so that the operation of the brake 2 shown in FIG. 1 leads only to a separation of the sheets of material from each other. Advantageously the web of sheet material 3 is weakened first by the shaver blade 24 and severed finally by the braking to avoid damage to the core-sleeve and roll supporting web feed drum 13.

Figure 4:
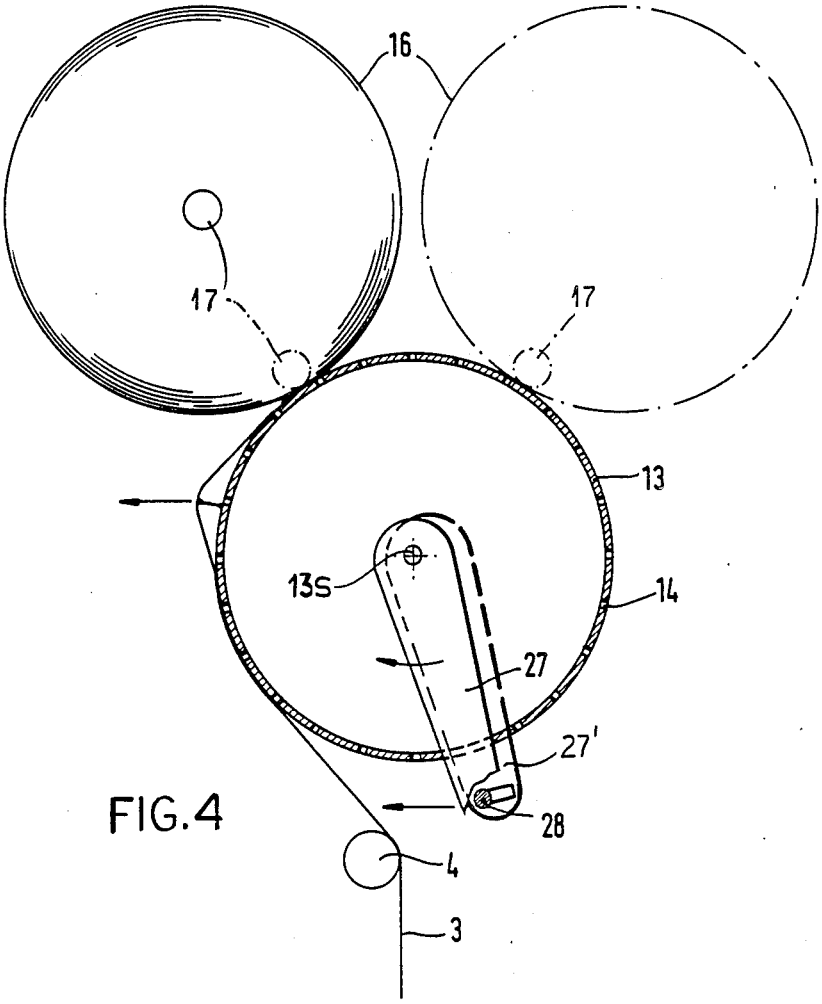
FIG. 4 is a schematic side view of a winder with another example of a cutting device according to our invention.

In the embodiment of FIG. 4 two arms 27 are positioned on each side of the core-sleeve and roll supporting web feed drum 13 between which a saw wire 28*a* or a heated wire 28 is stretched.

The sawing wire 28*a* (FIG. 4B) or heated wire 28 can be connected with a saw or wire drive 35 by which it can be moved both in a direction which is axially parallel to the core-sleeve and roll supporting web feed drum 13 and also runs radially to it. This drive 35 is actuated, and the saw or slowing wire 28 with the arms 27 are moved between the web of sheet material 3 and the core-sleeve and roll supporting web feed drum 13 and cover approximately half the distance to the fully wound roll 16. At that moment the web of sheet material 3 is cut through; however the web 3 remains adherant to the core-sleeve and roll supporting web feed drum 13 acted on by suction or vacuum.

After the cutting of the web of sheet material 3 the fully wound roll 16 is lowered (e.g. by member 15), the oncoming end of the web of sheet material with adhesive on it, contacts a new core 17. The beginning of the next web of sheet material 3 adheres to it and the arms 27 with the saw or electrically heated wire 28 stretched between them move with the core-sleeve and roll supporting web feed drum 13 further until the position shown in FIG. 4 is reached. It remains in this position until the web of sheet material 3 is cut through again.

Figure 5:
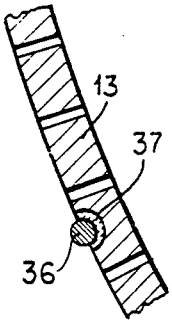
FIG. 5 is a sectional view illustrating another cutter.

The wire 28 can be replaced by an electrically heated wire 36 in a bed 37 of ceramic recessed in the drum 13 (FIG. 5) and through which current flows causing the wire to be heated and glow so that the web of sheet material 3 is burned through. The levers 27 can be dispensed with.

Also the cutting device shown in FIG. 4 is suitable to cut through the web of sheet material 3 either completely or only partially so that the web of sheet material 3 can be severed by operation of the brake 2 shown in FIG. 1.

In the process according to our invention a stoppage of the machine is required only for removal of the finished fully wound roll and for insertion of a fresh cartridge while the cutting and gluing occur with the machine running.

We claim:

1. A method of automatically producing wound rolls of a continuous web, comprising the steps of:

(a) supporting a roll core sleeve at least in part on a surface of a perforated drum;

(b) rotating said drum while applying suction to the interior thereof to advance a cut end of a continuous web of sheet material, having a strip of adhesive extending transverse ly of the web on a face thereof turned away from said surface, to said roll core sleeve and adhering said cut leading end to said core sleeve;

(c) roll winding by continuing to rotate said drum and said roll core sleeve as supported by said drum so as to wind a roll of said sheet material on said sleeve;

(d) upon completion of the roll winding, applying to said face on opposite sides of a severing line extending across said web, respective adhesive strips;

(e) severing the web on said surface at a location upstream of said roll to form a trailing end of a portion of said web constituting said roll and a leading end of an oncoming portion of said web and retaining both said leading and trailing ends carrying respective ones of the adhesive strips by suction against said surface;

(f) braking said oncoming portion of said web while retaining said leading and trailing ends by suction against said surface to complete winding of said trailing end upon said roll;

(g) replacing said roll with another core sleeve and releasing the braking of said oncoming portion so that said leading end forms a new cut end; and (h) repeating the preceding steps.

2. The process according to claim 1 wherein said adhesive strips are applied simultaneously with the severing of said web.

3. The process according to claim 1 wherein said adhesive strips are applied prior to severing of said web.

4. The process according to claim 1 wherein said web is weakened transversely before reaching said drum, both sides of the weakened location having said adhesive strips applied thereto and said web being quickly severed by rapid braking of the web.

5. The process according to claim 4 wherein the tension on said web is reduced before said weakening.

6. The process according to claim 4 wherein said adhesive strips are applied to said weakened location after said weakening.

7. The process according to claim 4 wherein said adhesive strips are applied to said weakened location simultaneously with said weakening.

8. The process according to claim 4 wherein said adhesive strips are applied to said weakened location before said weakening.

9. An apparatus for automatically producing wound rolls of a continuous web, comprising:

a perforated drum having a surface supporting a core sleeve;

means for rotating said drum while applying suction to the interior thereof to advance a cut end of a continuous web of sheet material, having a strip of adhesive extending transversely of the web on a face thereof turned away from said surface, to said core sleeve and adhering said cut leading end to said core sleeve, said means continuing to rotate said drum and said roll core sleeve as supported by said drum so as to wind a roll of said sheet material on said sleeve;

means, upon completion of roll winding, for applying to said face on opposite sides of a severing line extending across said web, respective adhesive strips;

means for severing the web on said surface at a location upstream of said roll to form a trailing end of a portion of said web constituting said roll and a leading end of an oncoming portion of said web and retaining both said leading and trailing ends carrying respective ones of the applied adhesive strips by suction against said surface;

means for braking said oncoming portion of said web while retaining said leading and trailing ends by suction against said surface to complete winding of said trailing end upon said roll; and means for replacing said roll with another core sleeve and releasing the braking of said oncoming portion so that said leading end forms a said cut end.

10. An apparatus for the automatic winding of a web of sheet material, comprising:

a delivery roll feeding a web of sheet material along a path from said roll with an outer side of said web turned away from said roll and an inner side of said web turned toward said roll;

at least one suction feed drum along said path engageable by said inner side of said web, said suction drum being partially peripherally contacted by said web;

a supporting member located along said path between said drum and said delivery roll;

a plurality of feed rollers mounted on said member, straddling said web and tangential to respective sides of said web for displacing said web along said path in a feed direction;

severing means pivotally mounted on said supporting member for severing said web, said severing means comprising:

an counter roller located on the outer side of said web, a perforating roller rotatable around an axis of rotation in a direction opposite the feed direction of said web and located across said web opposite said counter roller, and having a perforating comb on the periphery of said perforating roller producing a perforated line transverse to said feed direction in said web, and a clamping segment on said periphery located diametrically opposite said comb;

a stopping device operatively connected with said perforating roller so that said device brakes said perforating roller before said segment comes into contact with said web and presses said web against said counter roller, releases said perforating roller when said perforated line reaches the periphery of said drum, and brakes said perforating roller again at the moment at which said segment engages said web between itself and said counter roller causing a tearing force between said drum and said opposing roller which tears said web at said perforated line; and glue means along said path for applying a trace of adhesive on both sides of said perforated line to said outer side of said web.

11. The apparatus defined in claim 10, further comprising trimming means for trimming said web.

12. The apparatus defined in claim 10, further comprising a core sleeve supported on the periphery of said feed drum for winding a roll from the web advanced thereto by the drum.

13. The apparatus defined in claim 10, further comprising a lowering device engageable with a wound roll, said device replacing the wound roll with another core sleeve.

* * * * *